US007572145B1

(12) United States Patent
Wu

(10) Patent No.: US 7,572,145 B1
(45) Date of Patent: Aug. 11, 2009

(54) CABLE ASSEMBLY HAVING REINFORCEMENT STRUCTURE PROTECTING INTERIOR SHIELDING STRUCTURE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,495

(22) Filed: Jun. 27, 2008

(51) Int. Cl.
*H01R 13/648* (2006.01)

(52) U.S. Cl. ..... 439/607; 439/76.1; 439/460

(58) Field of Classification Search ..... 439/76.1, 439/344, 352, 460, 607, 620.01, 629, 660, 439/676

See application file for complete search history.

(56) References Cited

U.S. PATENT DOCUMENTS 5,207,586 A * 5/1993 MacGregor et al. ..... 439/76.1
5,330,360 A * 7/1994 Marsh et al. ..... 439/76.1
5,339,222 A * 8/1994 Simmons et al. ..... 361/818
5,462,457 A * 10/1995 Schroepfer et al. ..... 439/736
5,667,390 A * 9/1997 Keng ..... 439/76.1
5,747,735 A * 5/1998 Chang et al. ..... 174/51
5,797,771 A * 8/1998 Garside ..... 439/610
5,989,042 A * 11/1999 Johnson et al. ..... 439/131
6,135,807 A * 10/2000 Lai et al. ..... 439/455
6,139,357 A * 10/2000 Shih ..... 439/493
6,151,219 A * 11/2000 Dye ..... 361/737
6,166,913 A * 12/2000 Fun et al. ..... 361/737
6,210,178 B1 * 4/2001 DeForest, Jr. ..... 439/76.1
6,217,350 B1 * 4/2001 Johnson et al. ..... 439/131
6,431,901 B1 8/2002 Yeh
6,628,524 B1 * 9/2003 Washino et al. ..... 361/737
6,796,806 B2 * 9/2004 Boutros et al. ..... 439/76.1
6,866,539 B2 3/2005 Chang
7,223,915 B2 5/2007 Hackman
7,445,486 B2 * 11/2008 Shen et al. ..... 439/353

* cited by examiner

*Primary Examiner*—James Harvey
(74) *Attorney, Agent, or Firm*—Wei Te Chung

(57) ABSTRACT

A cable assembly includes a connector (1) having an insulated housing (10) and two primary arms (16) extending rearward from lateral sides of a back surface of the insulated housing; a plurality of contacts (100) received in the insulated housing; a printed circuit board (2) having a front portion and an opposite rear portion, with the front portion thereof connected to the connector; a cable (5) coupled to the rear portion of the printed circuit board; a metallic shell (300) arranged between the two primary arms and shielding outside of the printed circuit board and a cover (7) enclosing the metallic shell and the two primary arms.

17 Claims, 12 Drawing Sheets

CABLE ASSEMBLY HAVING REINFORCEMENT STRUCTURE PROTECTING INTERIOR SHIELDING STRUCTURE

CROSS-REFERENCE TO RELATED APPLICATION

This application is related to U.S. patent application entitled "Cable Assembly Having Interior Shielding Structure for Suppressing Electro-magnetic Interference", and it has the same applicant and assignee as the present invention. The disclosure of the related application is incorporated herein by reference.

FIELD OF THE INVENTION

The present invention generally relates to a cable assembly having anti-EMI structure, and more particularly to a connector having a reinforcement structure protecting an interior shielding structure therebetween.

DESCRIPTION OF PRIOR ART

Electromagnetic interference (or EMI, also called radio frequency interference or RFI) is a (usually undesirable) disturbance that affects an electrical circuit due to electromagnetic radiation emitted from an external source. The disturbance may interrupt, obstruct, or otherwise degrade or limit the effective performance of the circuit. The source may be any object, artificial or natural, that carries rapidly changing electrical currents, such as an electrical circuit, the Sun or the Northern Lights.

EMI can be induced intentionally for radio jamming, as in some forms of electronic warfare, or unintentionally, as a result of spurious emissions and responses, intermodulation products, and the like. It frequently affects the reception of AM radio in urban areas, cell phone, FM radio and television reception. It can also a data transmitting line between two electronic devices, such as a cable assembly.

A cable assembly, especially utilized for high-speed signal transmitting, has some precautions against EMI. Serial ATA connector assembly, which is widely used in recent years, equipped with anti-EMI structures in both cables and a connector. For example, U.S. Pat. No. 6,866,539 issued to Chang on Mar. 15, 2005 discloses a high frequency connector used for connecting with a high frequency transmission cable as to offer a function of transmitting signal of an electric appliance. The high frequency connector includes an insulation body with multiple terminal therein, a metal inner covering disposed at outer side of the insulation body and a jacket disposed at the outermost side of the connector. The terminals are electrically connected to the cable and the inner cover at an end thereof has a locating device for holding the cable.

A cable assembly has a different structure for anti-EMI and manufactured easily is required.

SUMMARY OF THE INVENTION

Accordingly, an object of the present invention is to provide an anti-EMI cable assembly.

In order to achieve the object set forth, a cable assembly in accordance with the present invention comprises a connector including an insulated housing and two primary arms extending rearward from lateral sides of a back surface of the insulated housing; a plurality of contacts received in the insulated housing; a printed circuit board having a front portion and an opposite rear portion, with the front portion thereof connected to the connector; a cable coupled to the rear portion of the printed circuit board; a metallic shell arranged between the two primary arms and shielding outside of the printed circuit board; and a cover enclosing the metallic shell and the two primary arms.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 11:
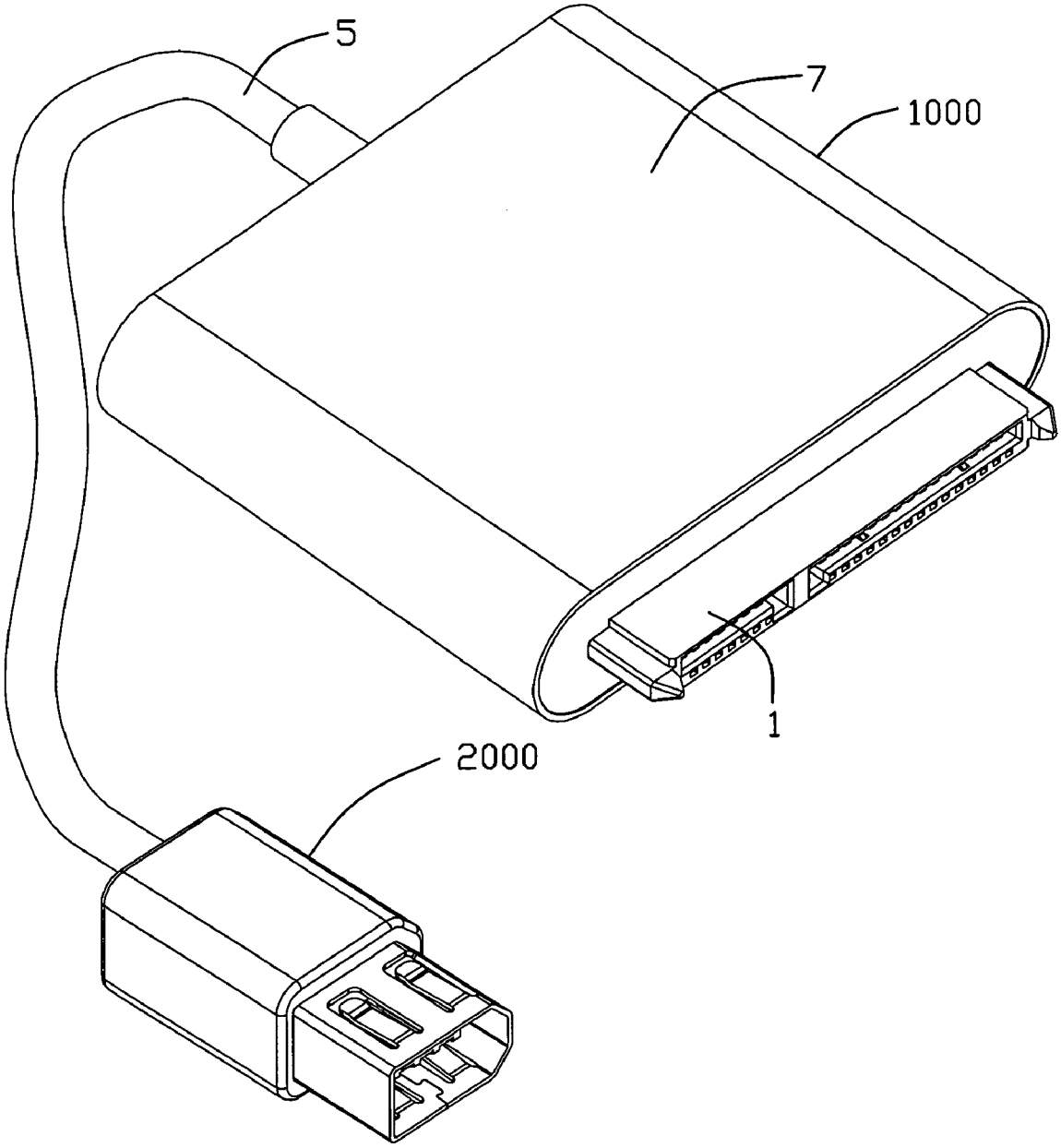
FIG. 11 shows the first connector assembly interconnects with a second connector of a cable assembly in accordance with the present invention.
Figure 12:
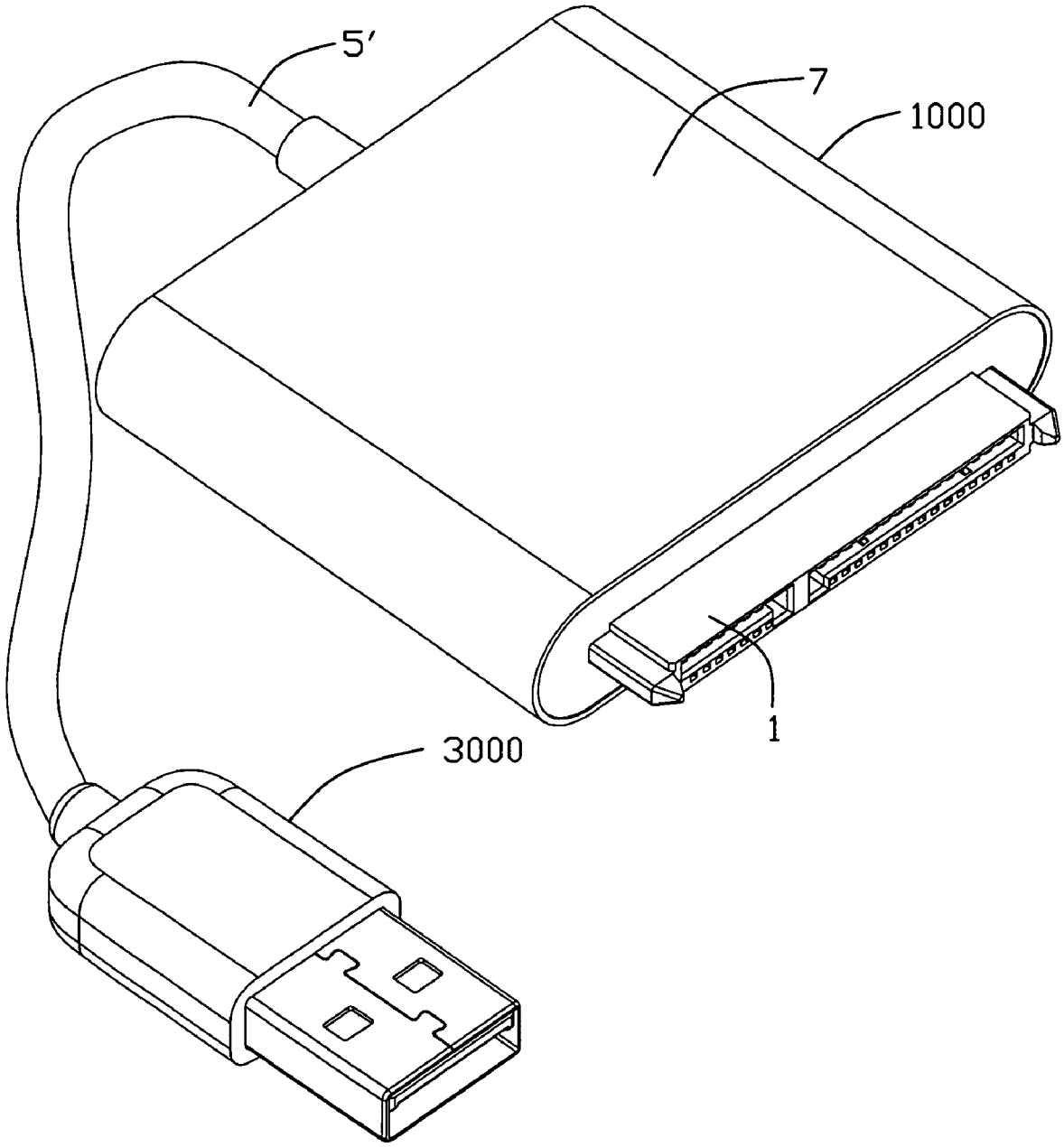
FIG. 12 shows the first connector assembly interconnects with a third connector of a cable assembly in accordance with the present invention.

Referring to FIGS. 11-12, a cable assembly in accordance with the present invention comprises a first connector assembly 1000 optionally interconnects with a second connector 2000 or third connector 3000. In the exemplary embodiment, the first connector assembly 1000 is adapted for Serial Advanced Technology Attachment (SATA) protocol, while the second connector 2000 adapted for IEEE 1394 protocol and the third connector 3000 is adapted for Universal Serial Bus (USB) protocol.

Referring to FIGS. 1-10, the first connector assembly 1000 comprises a first connector 1, a printed circuit board (PCB) 2, a metallic shell 300, a cable 5, a strain relief member 6 and a cover 7.

The first connector 1 includes an elongated insulated housing 10 has a plurality of walls (not numbered) corporately forming a receiving space (not numbered) therebetween. The receiving space is divided into two chambers 102, 104 by a spacer 101. Both the chambers 102, 104 are L-shaped viewed from a front side. A flange portion 12 is attached to a rear edge of the insulated housing 10 and extends beyond both an upper and lower surface of the insulated housing 10. A pair of guiding posts 106 are adjacent to lateral sides of the insulated housing 10 and extend forwardly from a front surface of the flange portion 12. A pair of secondary arms 14 extend rearward from a back surface of the flange portion 12 and substantially respectively align with the pair of guiding posts 106 along a mating direction, while another pair of primary arms 16 are respectively disposed outside of the secondary arms 14 and extend rearward from lateral sides of the back surface of the flange portion 12. Two gaps 144 formed between the primary arms 16 and the secondary arms 14, respectively. Each secondary arm 14 has a pair of positioning posts 142 formed on a lower surface thereof and a positioning cavity 146 recessed inwardly from a lateral surface thereof. A thin gasket 18 has a substantially same shape as that of the flange portion 12, said gasket 18 further having an elongated outlet 180 for the insulated housing 10 inserted therethrough. The gasket 18 is mounted to the insulated housing 10 and disposed adjacent to the flange portion 12.

The PCB 2 includes a circuit substrate 20, with a set of first conductive holes 220 arranged on a front portion 22 thereof. Two first positioning holes 222 are respectively located in lateral sides of a front segment of the PCB 2 and disposed behind the set of conductive traces 220. A cutout 241 is defined in a middle section of a rear portion 24 of the printed circuit board 2. Four holes 242 are separated into two rows and arranged along lateral sides of the cutout 241. Two second positioning holes 244 are defined in the rear portion of the PCB 2 and disposed outside of the holes 242. A plurality of second conductive holes 240 arranged on the rear portion 24 are separated into two groups and symmetrically disposed aside of the second positioning holes 244. A grounding pads 246 is disposed on the rear portion 24, in front of the cutout 241. The metallic shell 300 includes a first shielding part 3 and a second shielding part 4.

The first shielding part 3 has a top wall 32, two vertical walls 34, 36 extending downwardly from lateral edges of the top wall 32, a rear wall 38 extending downwardly from an end edge of the top wall 32 and a front wall 37 extending downwardly from a front edge of the top wall 32 to together form a first receiving space 30. The front wall 37 further defines two outlets 370 in lateral sides thereof. Two first positioning members 342, 362 respectively extend into the receiving space 30 from front portions of the two vertical walls 34, 36 and are adjacent to the outlets 370. A row of first arch-shaped stoppers 324 extend upwardly from a front portion of the top wall 32. Two first holes 344, 364 are defined in front segment of the vertical walls 34, 36, while another two second holes 348, 368 are defined in a rear segment of the vertical walls 34, 36. Two L-shaped first stumps 346, 366 extend into the first receiving space 30 from the two vertical walls 34, 36 and located behind the first holes 344, 364. A first semi-circular shaped outlet 382 is defined in a middle section of the rear wall 38. Two third holes 386 are defined in the rear wall 38 and disposed at lateral side of the outlet 382

An L-shaped second stump 384 extends into the first receiving space 30 from the rear wall 38 and is disposed at a lateral side of the third hole 386.

The second shielding part 4 is similar to the first shielding part 3 and also has a bottom wall 42, two vertical walls 44, 46 extending upwardly from lateral edges of the bottom wall 42, a front wall 47 extending upwardly from a front edge of the bottom wall 42, a rear wall 48 extending upwardly from an end edge of the bottom wall 42 to together form a second receiving space 40. A row of second arch stoppers 424 extend downwardly from front portion of the bottom wall 42. Two first tabs 444, 464 extend into the second receiving space 40 from front segment of the vertical walls 44, 46, while another two second tabs 448, 468 extend into the second receiving space 40 from rear segment of the vertical walls 44, 46. A second semi-circular shaped outlet 482 is defined in a middle section of the rear wall 48. Two third tabs 484 are arranged lateral sides of the second outlet 482 and extend into the second receiving space 40 from the rear wall 48, The cable 5 includes a plurality of wires 50, a metallic braiding portion 52 enclosing the wires 50, and a jacket 54 shielding the metallic braiding portion 52. The metallic braiding portion 52 and the jacket 54 of a front portion of the cable 5 are removed away, with the wires 50 exposed outside and separated into two groups, and each group has three individual wires 50. The strain relief member 6 has a body portion 60 molded over the front portion of the cable 5, with partial of metallic braiding portion 52 exposed outside. The strain relief member 6 has substantially T-shaped aligning member 62 in the front of body portion 60, with four posts 64 arranged at lateral sides thereof. The aligning member 62 is mounted to the cutout 241 of the PCB 2, with the four posts 64 inserted into the four holes 242 aside the cutout 241, thus the cable 5 is coupled to the PCB 2 reliably.

A gadget 8 is also utilized for manufacturing the first connector assembly 1000. The gadget 8 has a transverse beam 82 and a pair of retainers 81 arranged lateral sides of the transverse beam 82. Each retainer 81 further has a passage 810 therein. A pair of protrusions 812 extend downwardly from lateral sides of a bottom surface of the transverse beam 82 and disposed adjacent to the retainers 81, with a passage 814 formed therebetween.

When assemble, the contacts 100 is inserted into the insulated housing 10 of the first connector 1, with mating portions 101 extending into the receiving space thereof, tail portions 102 disposed outside of a rear surface of the insulated housing 10 and bent downwardly. Secondly, the strain relief member 6 is mounted to the PCB 2 and the wires 51 are inserted into the second conductive holes 240 of the rear portion 24 of the PCB 2. Thirdly, the gadget 8 is mounted to the connector 100, with the pair of second arms 16 inserted into the passages 810 of the retainers 81. Then the PCB 2 and an additional substrate 200 is respectively supported by the second arms 14 and protrusions 812 of the gadget 8, with the positioning posts 142 inserted into positioning holes 224 located in the front portion 22 of the PCB 2, with the rear portions 102 of the contacts 100 inserted into the first conductive holes 220 of the front portion 22 of PCB 2. The rear portion 102 of the contacts 100 and wires 50 are respectively soldered to the first conductive holes 220 and the second conductive holes 240. After soldering, the additional substrate 200 is broken off the PCB 2 along a notch 201 therebetween.

Fourthly, the first shielding part 3 is assembled to the first connector 1, with the front wall 37 disposed behind the flange portion 12, front portions of the two vertical walls 34, 36 inserted in the gaps 144 between the secondary arms 14 and the primary arms 16, the first positioning members 342, 362 engaging with the first positioning cavities 144 of the secondary arms 14; the PCB 2 accommodated in the first receiving space 30, the first stumps 346, 366 inserted into the first positioning holes 222 and soldered therein, the second stump 384 inserted into the second positioning hole 244 and soldered therein too.

Fourthly, the second shielding part 4 is assembled to the first shielding part 3, with first tabs 444, 464, second tabs 448, 468 and third tabs 484 thereof locked into the first holes 344, 364, second holes 348, 368 and third holes 386 of the first shielding part 3, the front wall 47 disposed behind the flange portion 12, the cable 5 extending outward through the outlets 382, 482 of the rear walls 38, 48. Thus, the first shielding part 3 and the second shielding part 4 are arranged between the pair of primary arms 16. Additionally, a pair of L-shaped patching members 8 are attached to rear corners (not numbered) of the first and second shielding part 3, 4 and further located in sunken portions 162 of rear portions of the primary arms 16. Fifthly, the first shielding part 3 and the second shielding part 4 are inserted into a hollow portion 70 of the cover 7, with the first stoppers 324 of the shielding part 3, the second stoppers 424 of the second shielding part 3 engaging inner sides of the cover 6. Glue (not shown) is applied to grooves 164 of the primary arms 16, thus the cover 7 may combine with the first connector 10 more reliably. Sixthly, the cable 5 is coupled to the second connector 2000. The primary arms 16 have guiding function facilitating the cover 7 assembled to the first and second shielding parts 3, 4; furthermore, the primary arms 16 may be a reinforcement structure that can protect the first shell part 3 and the second shell part 4 deformation for external force exerted thereon.

Figure 1:
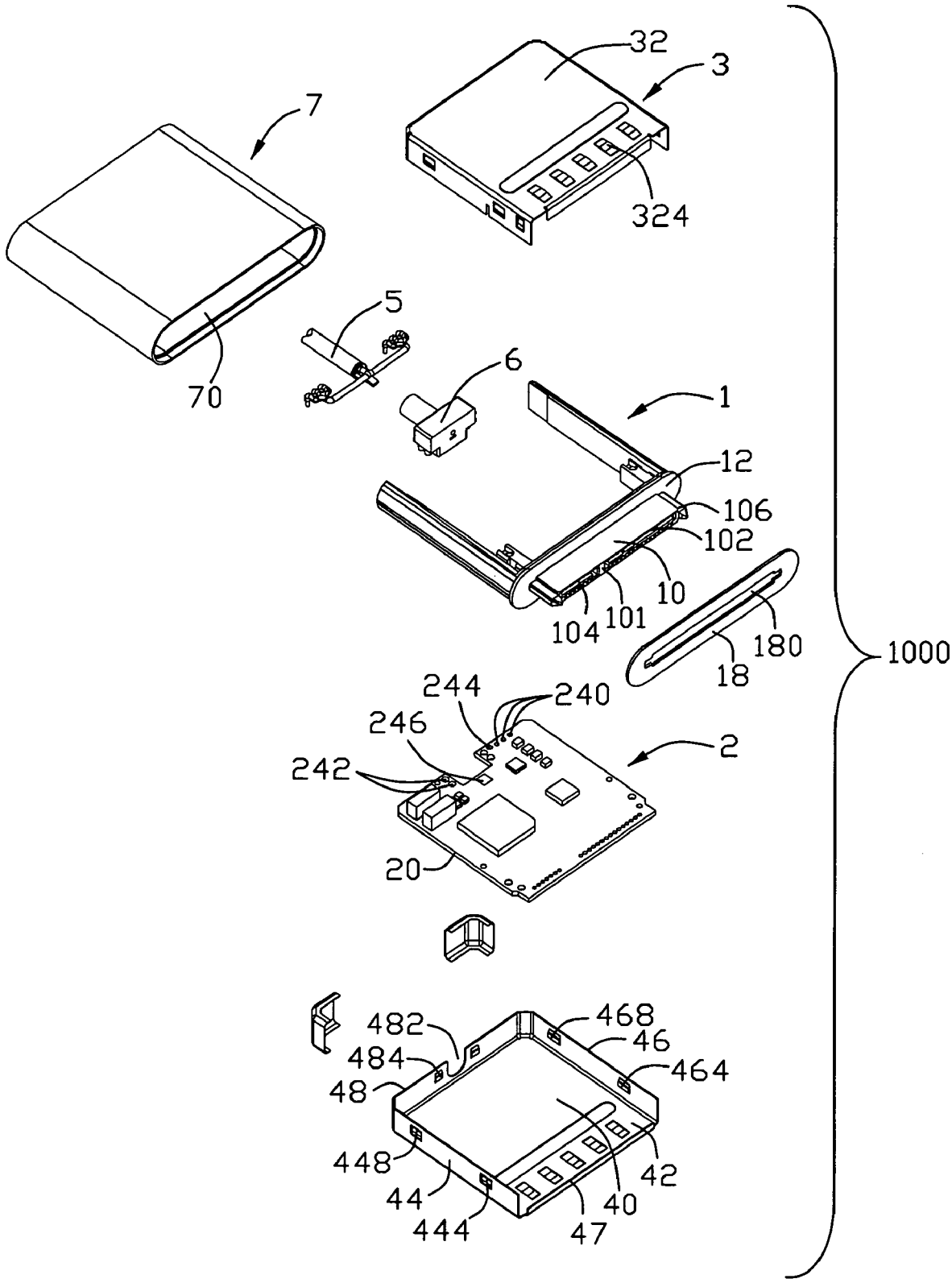
FIG. 1 is an exploded, perspective view of a first connector assembly.
Figure 2:
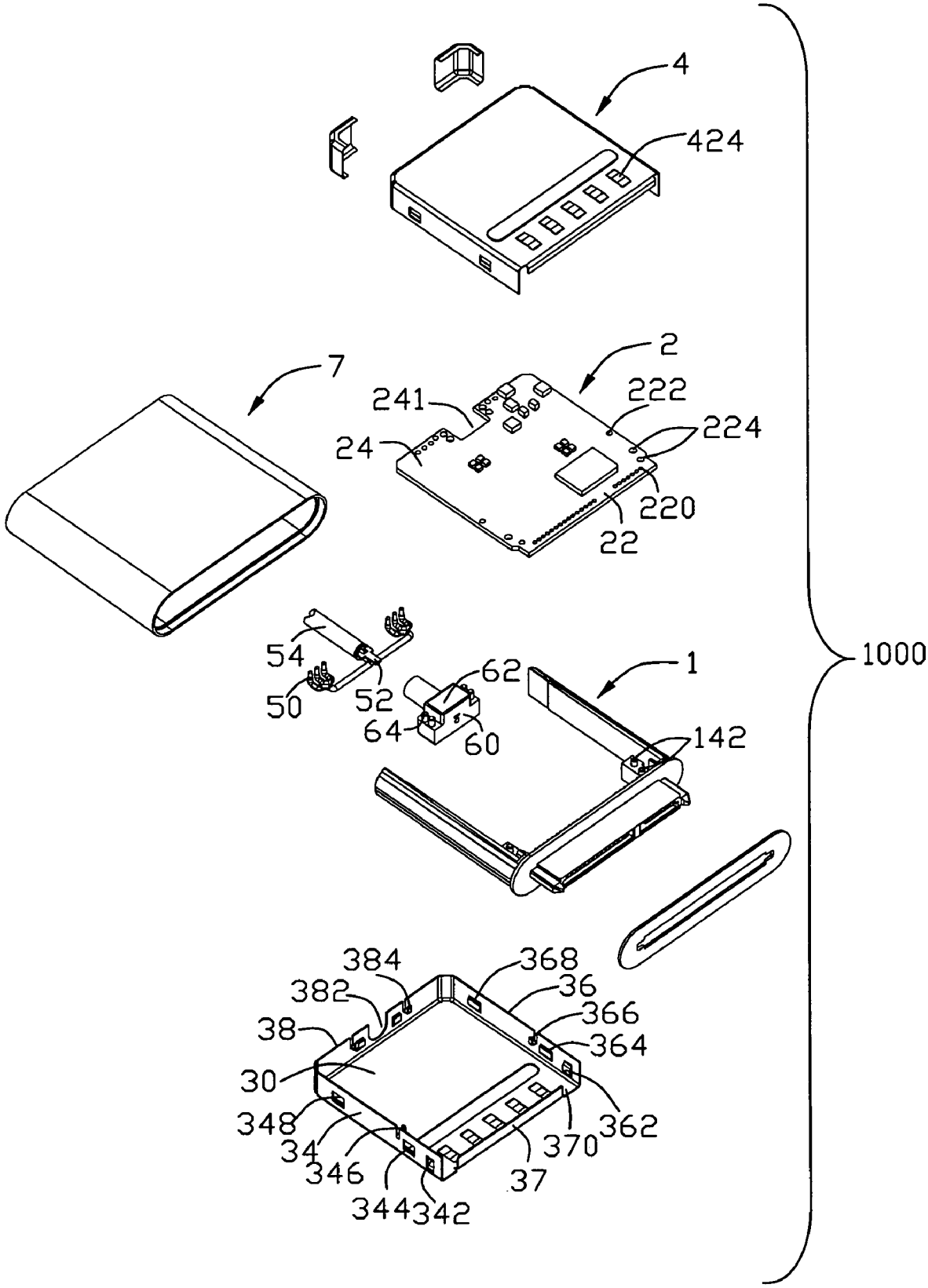
FIG. 2 is similar to FIG. 1, but viewed from another aspect.
Figure 3:
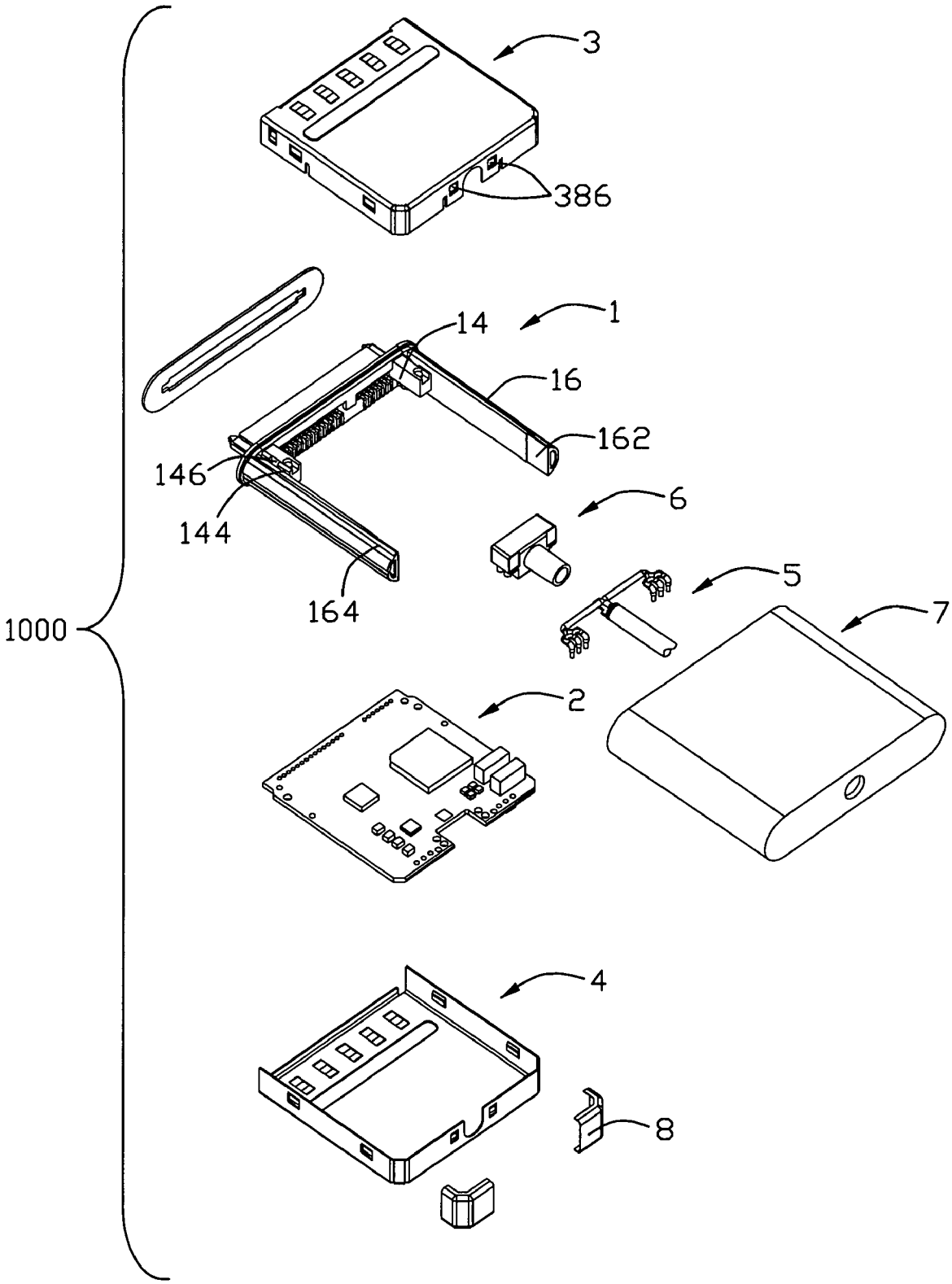
FIG. 3 is similar to FIG. 1, but viewed from other direction.
Figure 4:
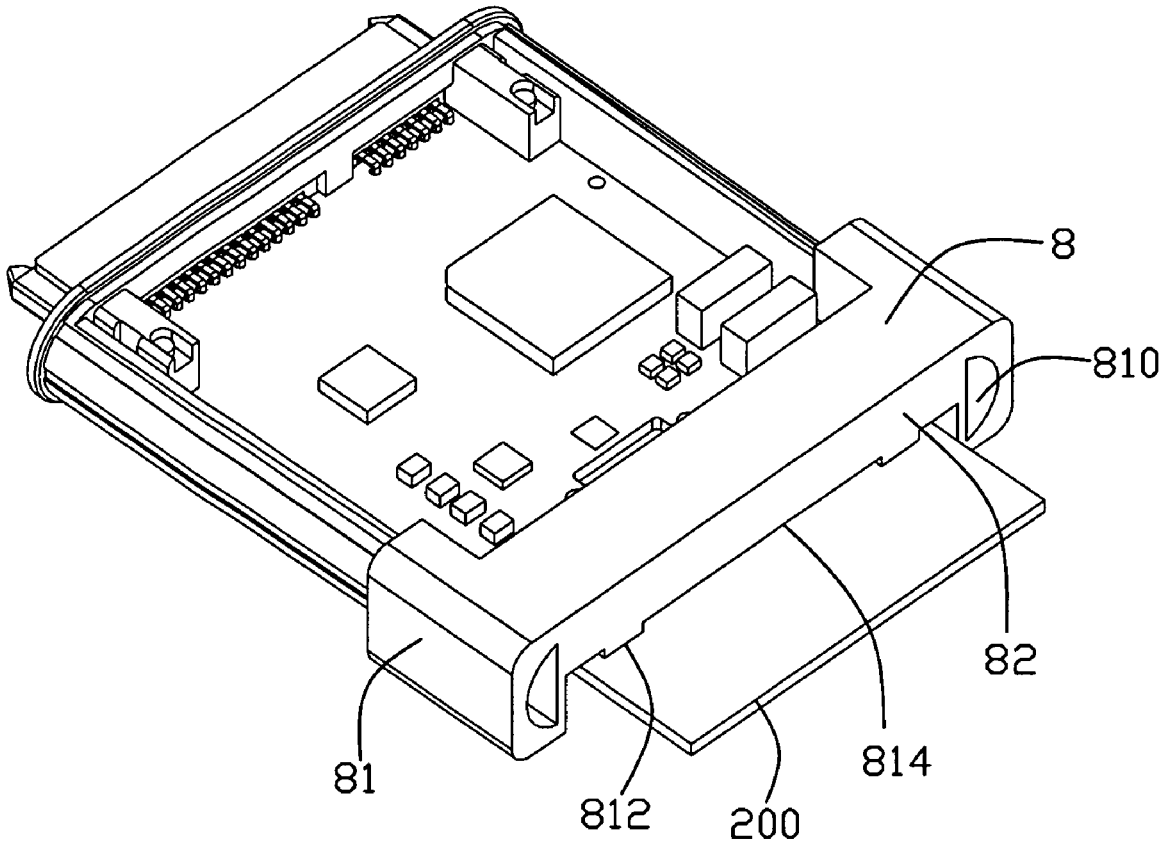
FIG. 4 illustrates a gadget utilized for holding the connector and a printed circuit board facilitating soldering process.
Figure 5:
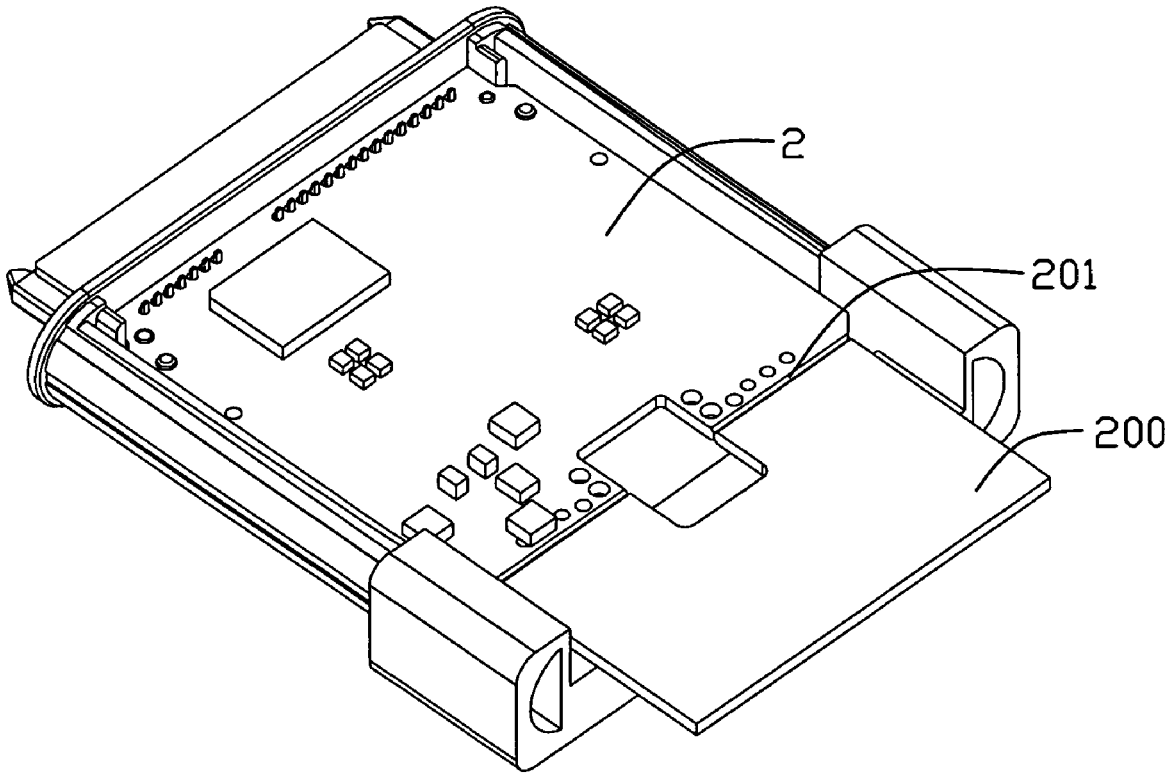
FIG. 5 is similar to FIG. 4, but viewed from another aspect.
Figure 6:
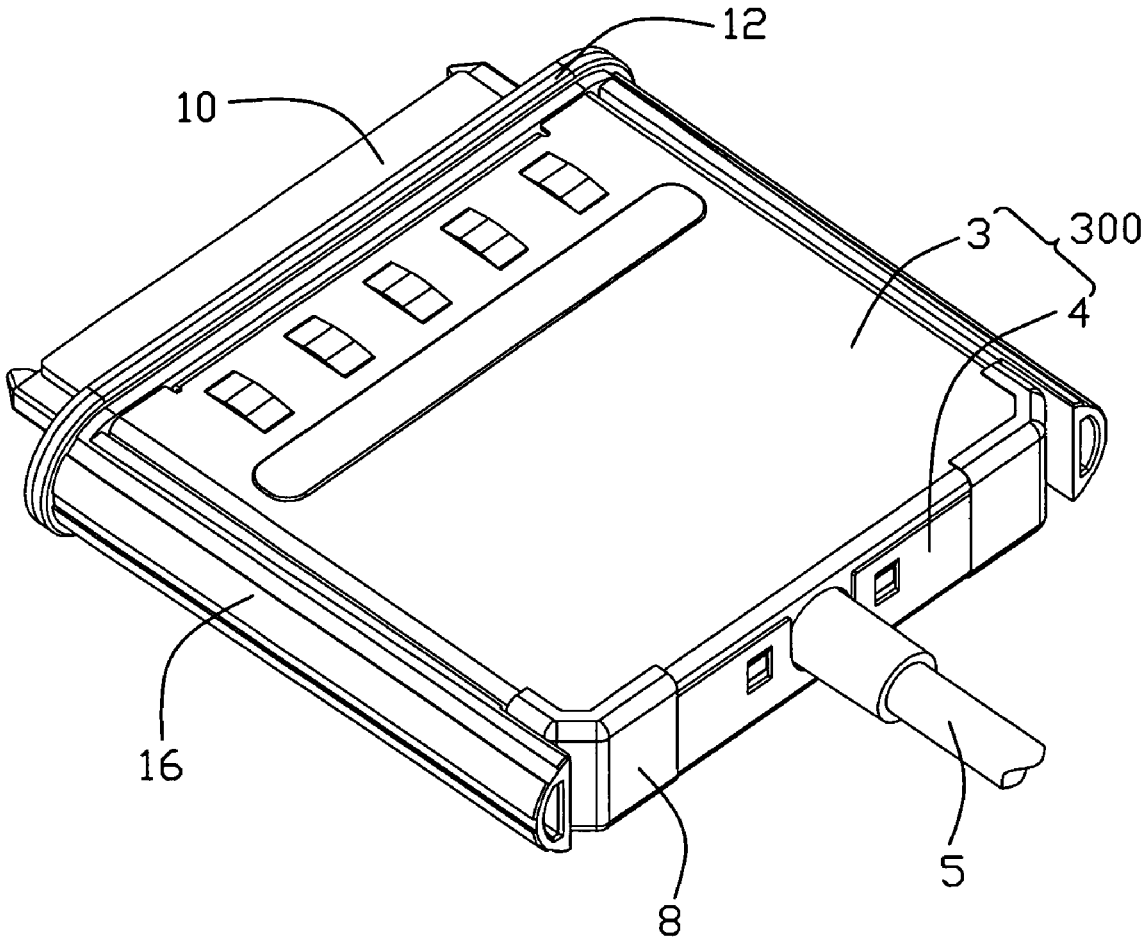
FIG. 6 is a partially assembled, perspective view of the first connector assembly.
Figure 7:
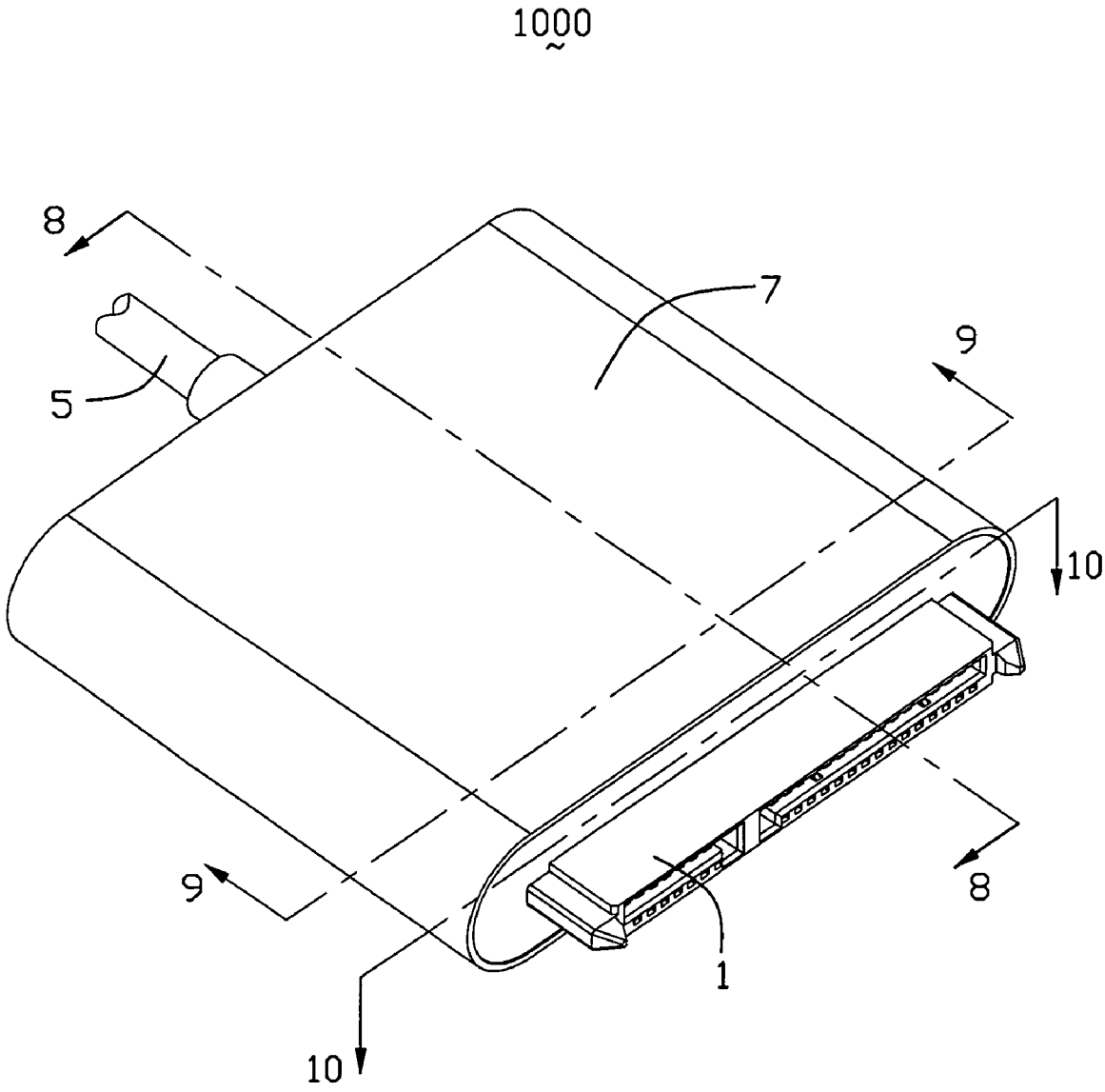
FIG. 7 is an assembled, perspective view of the first connector assembly.
Figure 8:
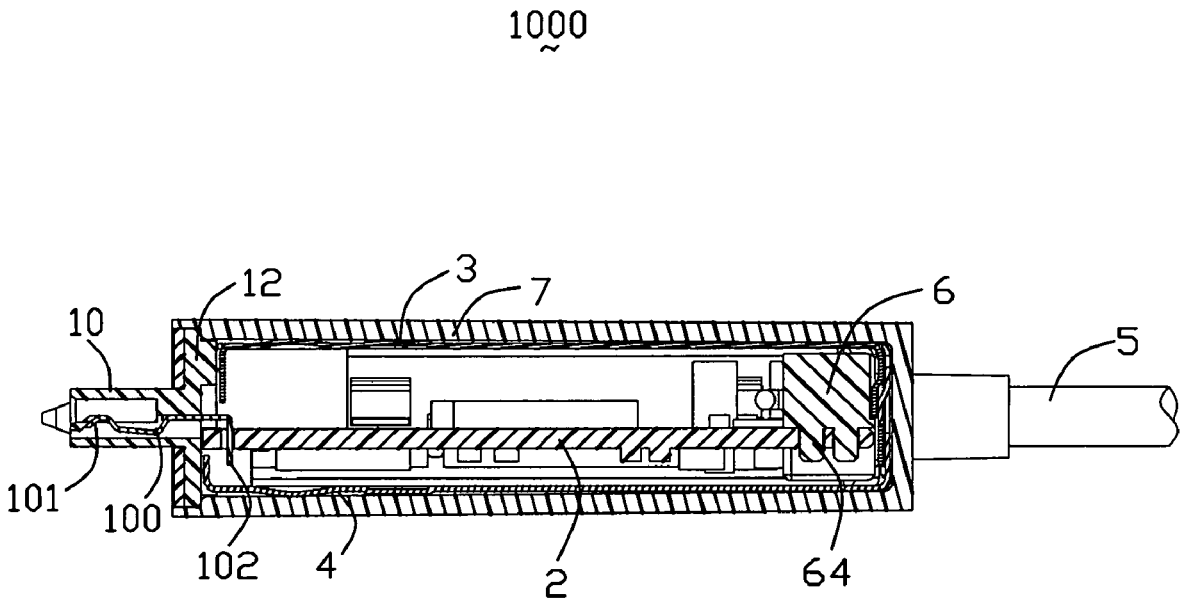
FIG. 8 is a cross-section view taken along line 8-8 of the FIG. 7.
Figure 9:
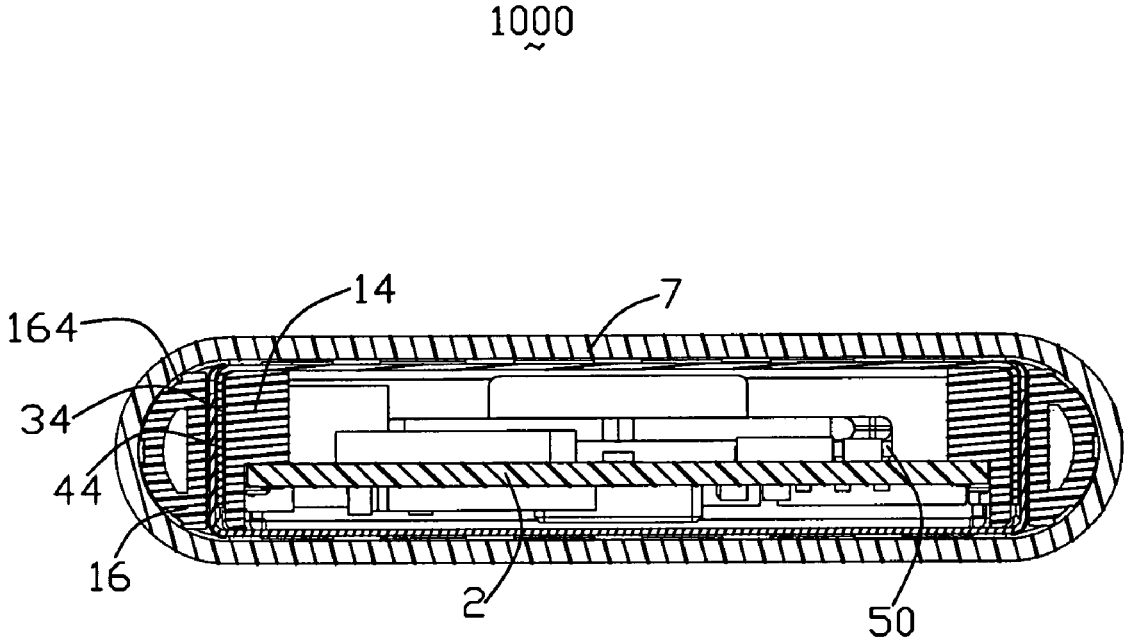
FIG. 9 is a cross-section view taken along line 9-9 of the FIG. 7.
Figure 10:
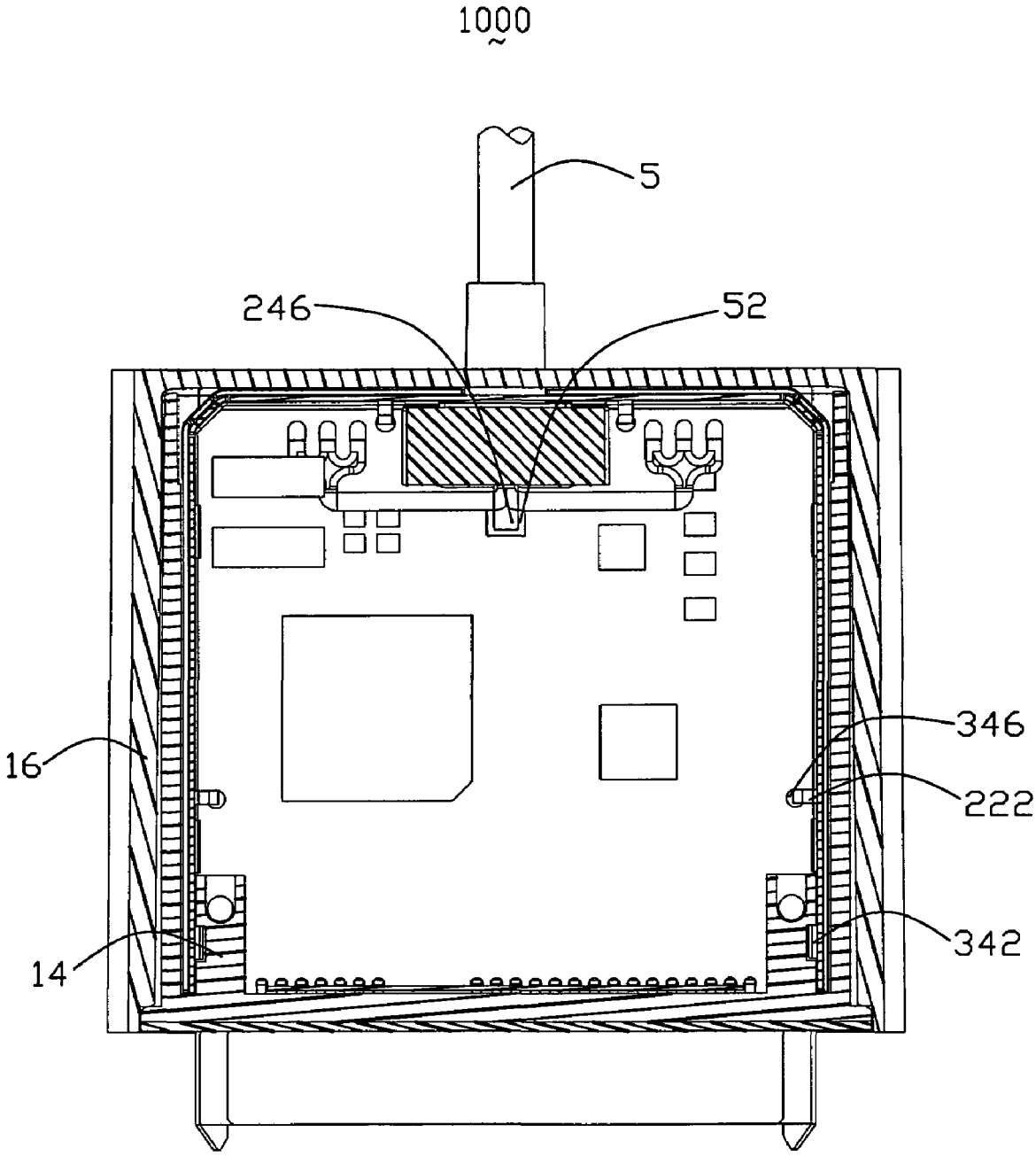
FIG. 10 is a cross-section view taken along line 10-10 of the FIG. 7.

FIG. 9 illustrates that the first connector assembly 1000 connects to the third connector 3000 via another cable 5'. The cable 5' is similar to the aforementioned cable 5, excepted that only four wires therein and respectively soldered to second conductive holes (not shown) aside the first conductive holes 240, and other same structure is omitted hereby.

In the preferred embodiment, the first connector assembly 1000 is alternatively coupled to the second connector 2000 and the third connector 3000 by selecting different conductive pads of the PCB 2, however, more different conductive pads for more connectors is anticipated by the present invention. Furthermore, the PCB 2 can be connected to different connectors, optionally, which may be convenient for producers, and the cost of the production is decreased.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

a connector including an insulated housing and two primary arms extending rearward from lateral sides of a back surface of the insulated housing;

a plurality of contacts received in the insulated housing;

a printed circuit board having a front portion and an opposite rear portion, with the front portion thereof connected to the connector;

a cable coupled to the rear portion of the printed circuit board;

a metallic shell arranged between the two primary arms and shielding outside of the printed circuit board; and a cover enclosing the metallic shell and the two primary arms;

wherein a pair of secondary arms extend rearward from the back surface of the insulated housing and are arranged adjacent to the primary arms, respectively, with vertical walls of the metal shell sandwiched therebetween.

2. A cable assembly, comprising:

a connector including an insulated housing and two primary arms extending rearward from lateral sides of a back surface of the insulated housing;

a plurality of contacts received in the insulated housing;

a printed circuit board having a front portion and an opposite rear portion, with the front portion thereof connected to the connector;

a cable coupled to the rear portion of the printed circuit board;

a metallic shell arranged between the two primary arms and shielding outside of the printed circuit board;

a cover enclosing the metallic shell and the two primary arms;

wherein the metallic shell has a number of walls together defining a receiving space therebetween to receive the printed circuit board therein; and wherein the metal shell has a plurality of stumps extending into the receiving space and are inserted into positioning holes of the printed circuit board.

3. The cable assembly as recited in claim 1, wherein each secondary arm has a positioning cavity defined in a lateral surface thereof, wherein a positioning member is formed on the vertical wall locking into the positioning cavity.

4. The cable assembly as recited in claim 1, wherein a positioning post is formed on the secondary arm and inserted into a positioning hole in the front section of the printed circuit board.

5. The cable assembly as recited in claim 1, wherein the metallic shell has a number of walls together defining a receiving space therebetween to receive the printed circuit board therein.

6. The cable assembly as recited in claim 5, wherein the metal shell has a plurality of stumps extending into the receiving space and are inserted into positioning holes of the printed circuit board.

7. The cable assembly as recited in claim 6, wherein the stumps are soldered in the positioning holes of the printed circuit board.

8. The cable assembly as recited in claim 1, wherein tail portions of the contacts extend beyond a rear surface of the insulated housing and are inserted into first conductive holes arranged in the front portion of the printed circuit board.

9. The cable assembly as recited in claim 1, wherein at least a groove is defined in the primary arm, wherein glue is applied to the groove to make the primary arm and the cover retained to the primary arm.

10. The cable assembly as recited in claim 1, wherein the metal shell including a first shield part and a second shield part.

11. The cable assembly as recited in claim 10, wherein the vertical walls of the first shield part respectively overlapping with the vertical walls of the second shield part are sandwiched by the primary arms and the secondary arms.

12. The cable assembly as recited in claim 10, wherein the first shield part latches with the second shield part.

13. The cable assembly as recited in claim 10, wherein the connector has an insulated housing, with a flange portion attached to a rear surface of the insulated housing.

14. The cable assembly as recited in claim 13, wherein front walls of the first shield part and the second shield part are located behind the flange portion.

15. The cable assembly as recited in claim 13, wherein a pair of guiding post arranged lateral sides of the insulated housing and extending forward from front surface of the flange portion.

16. The cable assembly as recited in claim 15, wherein the secondary arms extend rearward from the back surface of the flange portion and substantially align with the guiding posts along a mating direction.

17. The cable assembly as recited in claim 1, wherein a strain relief member is molded over a front portion of the cable and fastened to the rear portion of the printed circuit board.

* * * * *